US005694914A

United States Patent [19]

Henschel

[11] Patent Number: 5,694,914

[45] Date of Patent: Dec. 9, 1997

[54] WINDOW ASSEMBLY FOR A COMPOUND BOW

[75] Inventor: Louis G. Henschel, Rte. 4, Box 290-D, Pikeville, Tenn. 37367

[73] Assignee: Louis G. Henschel, Pikeville, Tenn.

[21] Appl. No.: 629,745

[22] Filed: Apr. 9, 1996

[51] Int. Cl.[6] ..... F41B 5/10

[52] U.S. Cl. ..... 124/86; 124/25.6

[58] Field of Search ..... 124/23.1, 25.6, 124/86, 90

[56] References Cited

U.S. PATENT DOCUMENTS

| | | | |
|---|---|---|---|
| 4,203,412 | 5/1980 | Rickard | 124/90 X |
| 4,834,061 | 5/1989 | Chattin | 124/86 |
| 4,917,070 | 4/1990 | Townsend | 124/25.6 X |
| 4,917,108 | 4/1990 | Larson | 124/25.6 X |

*Primary Examiner*—John A. Ricci

[57] ABSTRACT

The window assembly for a compound bow is a device to create an unobstructed window to allow arrow release from a compound bow which includes a bow string, and power cables which extend between the bow limbs and would intersect the arrow launch path, thus potentially interfering with the arrow. Unlike previous designs in which the power cables are continuous and are pushed to the side by a cable guard, creating friction and torque, the window assembly actually replaces the portion of each cable which may interfere with the arrow. The window assembly comprises front and back bodies, slidably connected. Each body includes an elongated member, and upper and lower heads laterally offset from the elongated member. The upper head of the front body is attached to the portion of one power cable which extends from the upper limb; the lower head of the front body is attached to the portion of the one power cable which extends from the lower limb. The heads of the back body are likewise connected to the other power cable. The elongated members transmit the force of the cables while being offset from the bow central plane to allow unobstructed arrow release.

10 Claims, 5 Drawing Sheets

WINDOW ASSEMBLY FOR A COMPOUND BOW

The present invention is designed to intersect and attach to the cables of a compound bow. With employment of an index reference, it develops a window which allows the arrow to be discharged from the compound bow without cable interference. The present invention relates to an improved means to retain the cables of a compound bow in its natural state.

BACKGROUND OF INVENTION

1. Technical Field

The present invention relates to a compound bow, in particular the working means of the cables. The invention, when attached to the cables of the compound bow, relates to the means which allows the arrow to be discharged through a window without cable interference. Furthermore, it allows the cables of the compound bow to function in their natural state. The configuration consists of two bodies with heads, caps, and an interlocking guide post and bearings.

2. Description of the Prior Art

There has always been a problem with the working means of the cables on a compound bow, in order to create a clear path for an arrow to be discharged without cable interference. Cables are positioned and braced to one side of a riser by a cable guard. The cable guard is a bar that projects from the back of a bow. The cable slides along this bar when the bow is drawn and discharged. Conclusively, the drawback of this design is the unilateral friction that is produced, which causes attrition to the cables, wheels, and bow string. Furthermore, the unilateral stress creates torque in the limb area. The negatives of the cable guard are directly responsible for decreasing the speed of the arrow.

SUMMARY OF THE INVENTION

The present invention provides a means for dealing with these problems by disclosing a Window Assembly for a Compound Bow.

The invention comprises two main bodies, front and back. The bodies have heads and retaining caps, located on both ends of the bodies. The back body's accessories are the same as the front in configuration except their heads extend slightly higher. The back body has two positions for the guide post to facilitate right and left hand bows. The front and back bodies are interconnected by the guide post and bearing. The guide post and bearing traverses in the channel of the front body.

The index lines are positioned directly under the center of the arrow when the window is attached to the cables.

The heads are perpendicular to the arrow and the bodies are parallel. The apparatus travels along its own device as it is moved by the cables, when the compound bow is activated.

It is thus the object of this invention to develop a window for an arrow to be discharged from a compound bow without cable interference.

It is a further object of the invention to allow the cables to perform in their natural line.

It is a further object of this invention to delete the torque of the bow.

It is a further object of the invention to delete the premature wear on the wheels, cables, and bow string.

It is a further object of the invention to allow the compound bow to be drawn with less effort.

It is a further object of this invention to be applied to all types of cables of various materials.

It is a further object of this invention to eliminate the unilateral friction.

It is a further object of this invention to be used with all draw lengths.

It is a further object of this invention to provide a means for either right or left hand bows.

It is a further object of this invention to assist in the accuracy of the compound bow.

Further objects and advantages of the present invention will become apparent upon further study of the specifications and claims.

BRIEF DESCRIPTION OF THE DRAWINGS

The more specific objects, features and advantages of this invention will be more readily apparent from the following description, wherein reference is made to the accompanying drawings illustrating the preferred embodiments of the invention.

In the drawings.

DETAILED DESCRIPTION OF THE PREFERRED EMBODIMENTS

Figure 1:
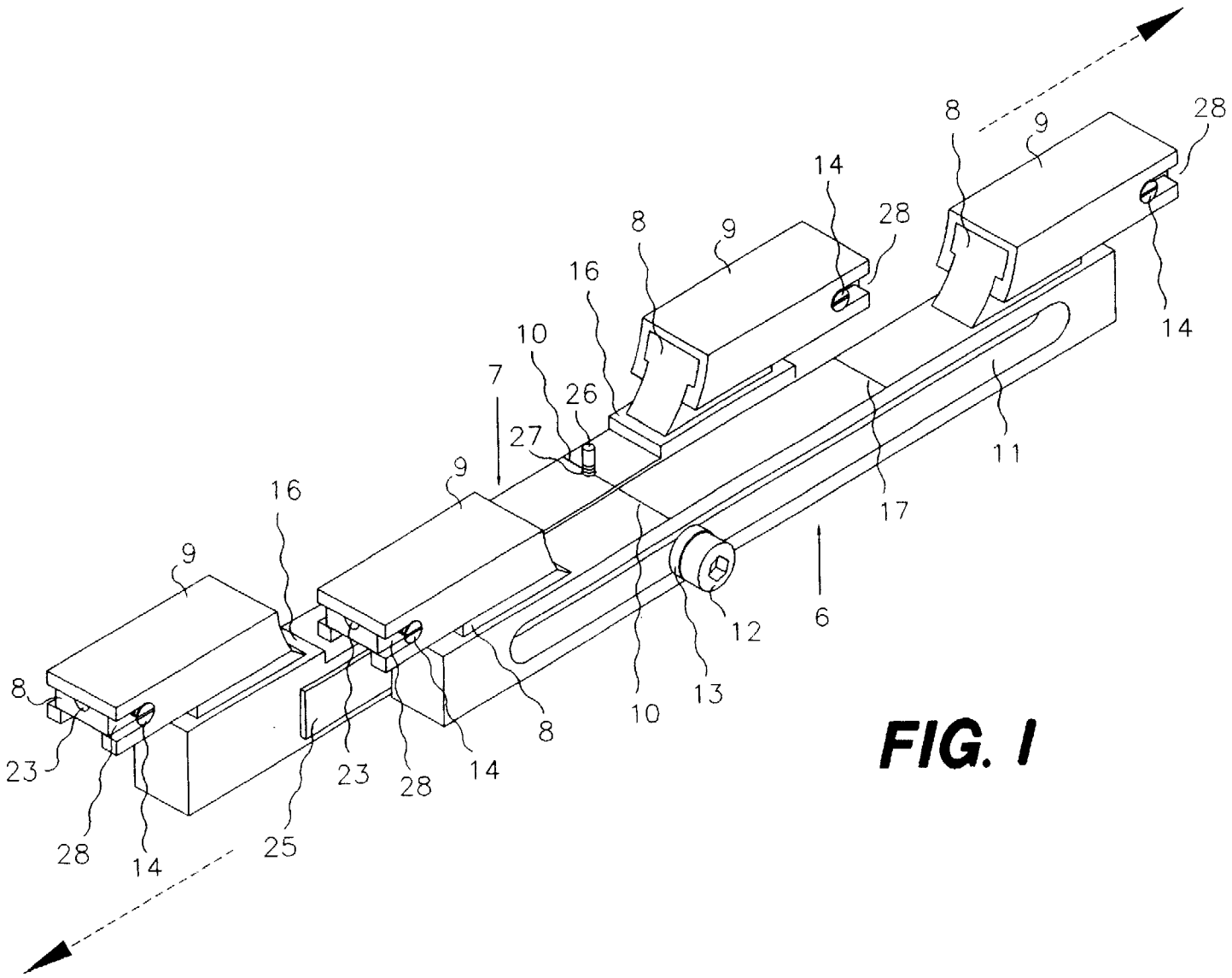
FIG. 1, shows a view of the assembled Window for a Compound Bow.

Although specific embodiments of the invention have been illustrated in the drawings, and the following description is presented in reference to these embodiments, this description is not intended to limit the scope of the invention which is defined in the appended claims.

Generally, the invention provides the material and means for an arrow to be discharged from a compound bow without cable interference. The invention comprises a two body configuration interconnected by a guide post. Each end of the bodies has a configuration that provides the means of attaching to the cables of a compound bow.

FIG. 1 illustrates a complete view of the Window Assembly for a Compound Bow. It is shown that the front body 6 and back body 7 are interconnected by the bearing 13 and guide post 12. The bearing 13 and guide post 12 are seated in the guide channel 11 of the front body 6. The front body 6 is approximently 6" in length and the back body 7 is approximently 4¾" in length. The above given lengths of the bodies are the means of the short and medium draw lengths. Increasing the length of the front body 6 and back body 7, plus the front body 6 channel 11, provides the means for the longer draw lengths. The index line 10 in direct line of one another develops the window which can be observed between the front body 6 and the lower head 8 and back body 7, top head 8. The bolt 26 in the right hand index line 10 is to secure the guide post 12.

Figure 2:
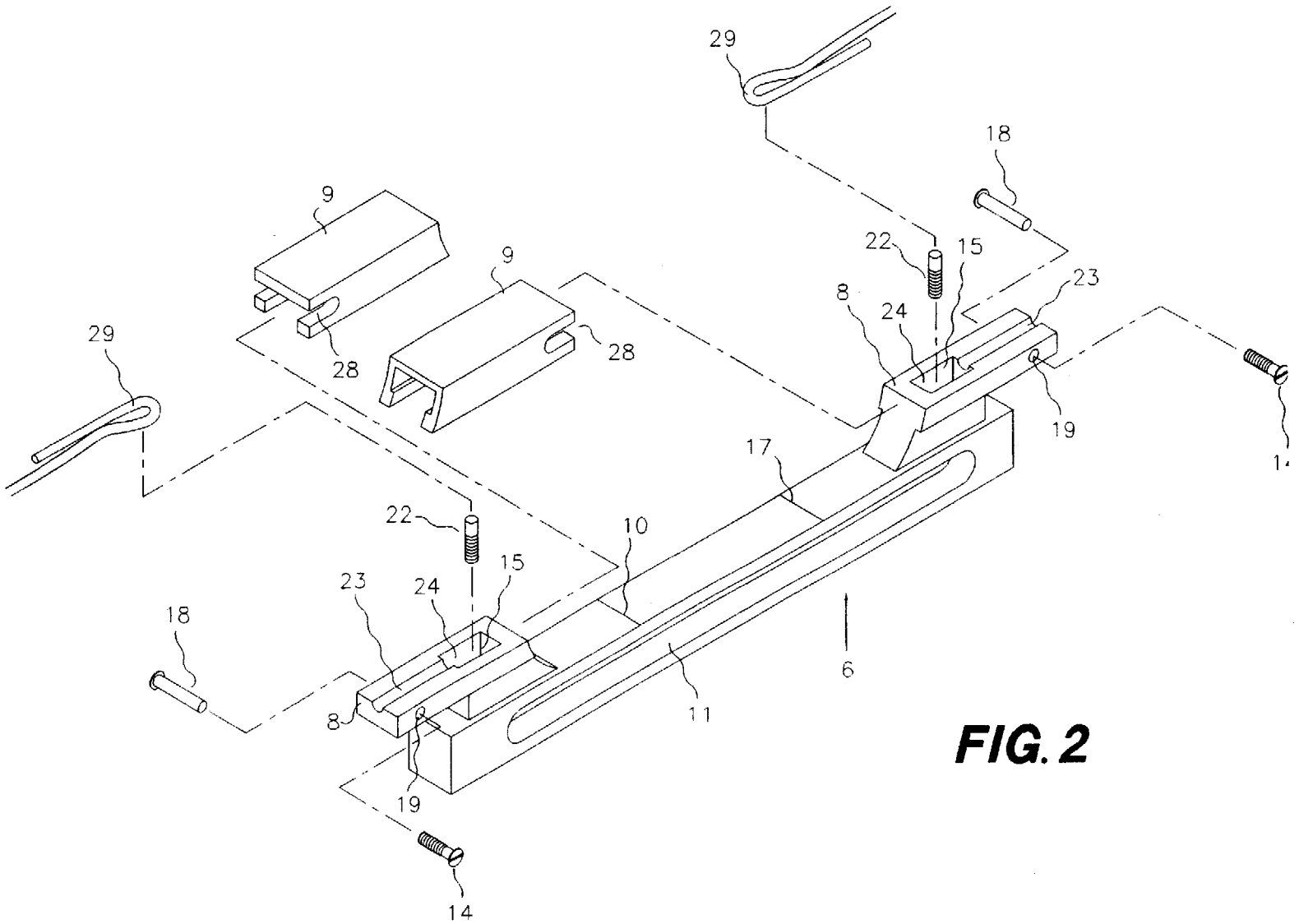
FIG. 2, shows a front body assembly with the caps removed and the internal configurations of the heads.

FIG. 2 illustrates a top and side view of the front body 6, also with the caps removed from the heads 8. This view of the heads 8 reveals the internal configuration of the heads 8. The channel 23 of the heads 8 seat and control the movement of the cables 29 and to secure to the anchor post 22, which is threaded into the depression 24. It can be observed on the end of the head 8 is located hole 19 slightly oversized to receive the hollow bolt 18. The bolt 18 is threaded internally, placed in the hole 19 to receive the bolt 14. This system provides for the cap 9 to slide with the aid of the extrusion forward to the bolt 18 and 14 to enter the slots 28 on the end of the caps 9 for securing the cap 9 to the heads 8 as shown in FIG. 1. With the cap 9 in place, the cable loop 29 can't slide off the anchor post 22. The anchor bolt 22 is held in position by the threaded hole 15 in the bottom of the depression 24. The lines 10 and 17 located on the top side of the front body 6 are referred to as an index for developing a window in proper location.

Figure 3:
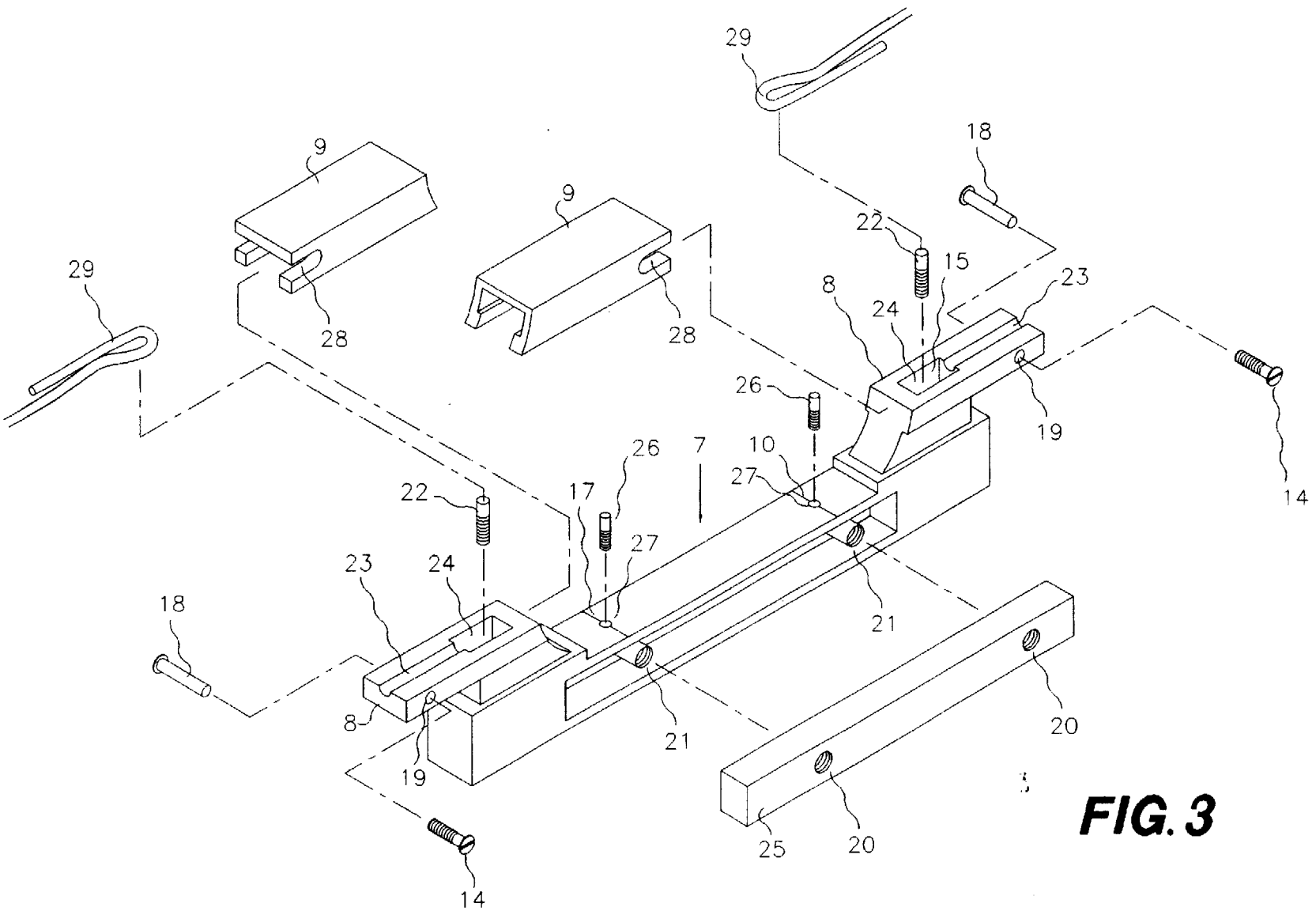
FIG. 3, shows the back body with the caps removed and also the internal configuration of the heads, plus the bosses and dividing slide bearing assembly.

FIG. 3 shows the back body 7. The channel 34 and bosses 21 are designed to receive and secure the dividing bearing 25. The step 16 on the back body 7 increases the vertical height of the heads 8. It also shows in detail the head 8 and caps 9 configuration, and are identical as in FIG. 2, heads 8 and caps 9, except in height. Also shown are right hand index line 10 and left hand index line 17. The index line 10 of a back body 7 must line up with the front body 6 index line 10, as in FIG. 2. This develops the window. The said configuration of the heads 8 and caps 9 are the same as FIG. 2.

Figure 4:
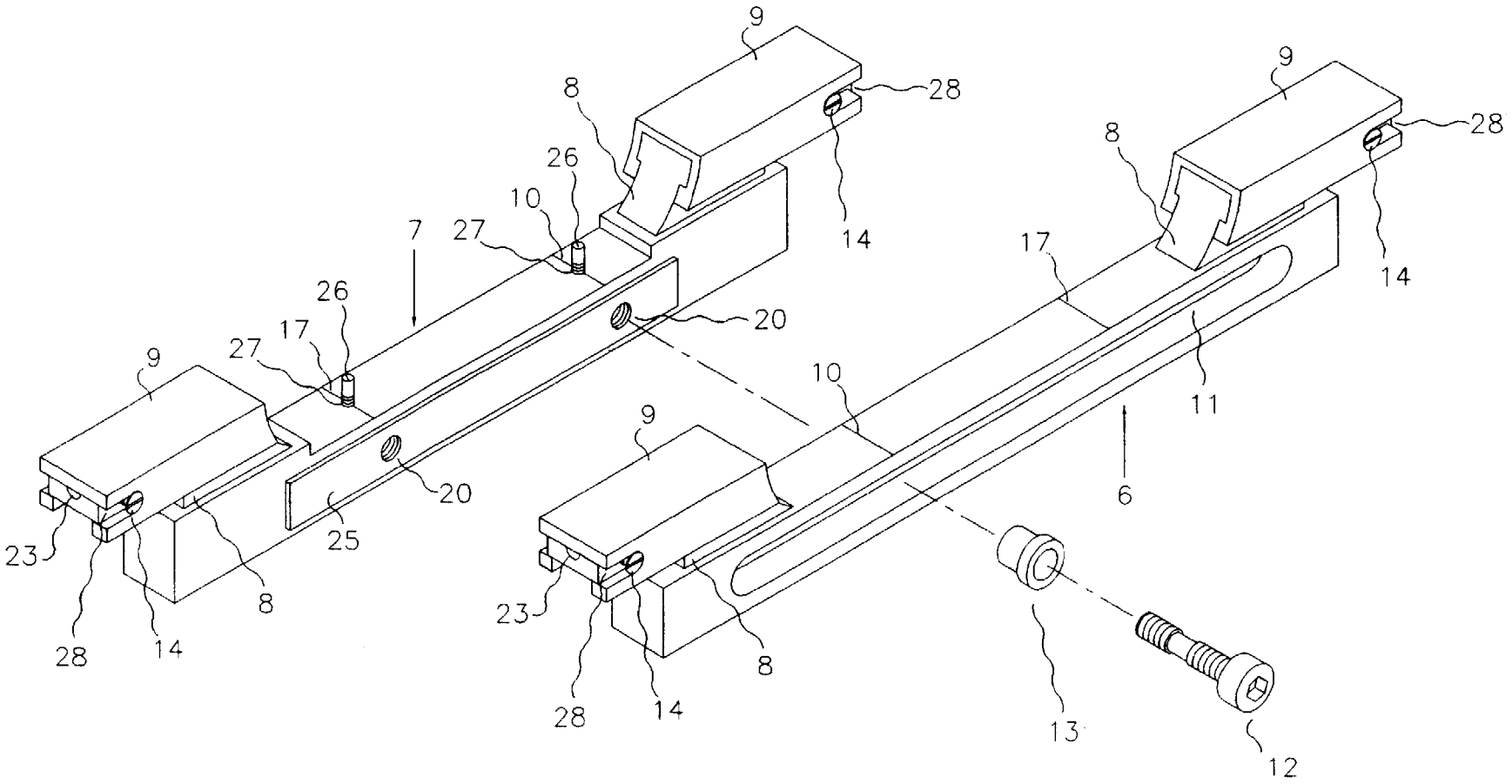
FIG. 4, shows the two bodies with the dividing slide bearing installed in the back body and the guide post and bearing.

FIG. 4 shows body 6 and body 7 assembled individually. The guide post 12 and bearing 13 are in line to enter the channel 11 in which they travel. The guide post 12 threads into the dividing slide bearing 20 and boss 21 shown on FIG. 3. The guide post 12 threads are interrupted. When threaded in place, the locking bolt 26 screws down the threaded hole 27 and makes contact in the interrupted area of the guide post 12. The dividing slide bearing 25 protrudes from the back body 7, this space avoids any contact between the two bodies 6 and 7.

Figure 5:
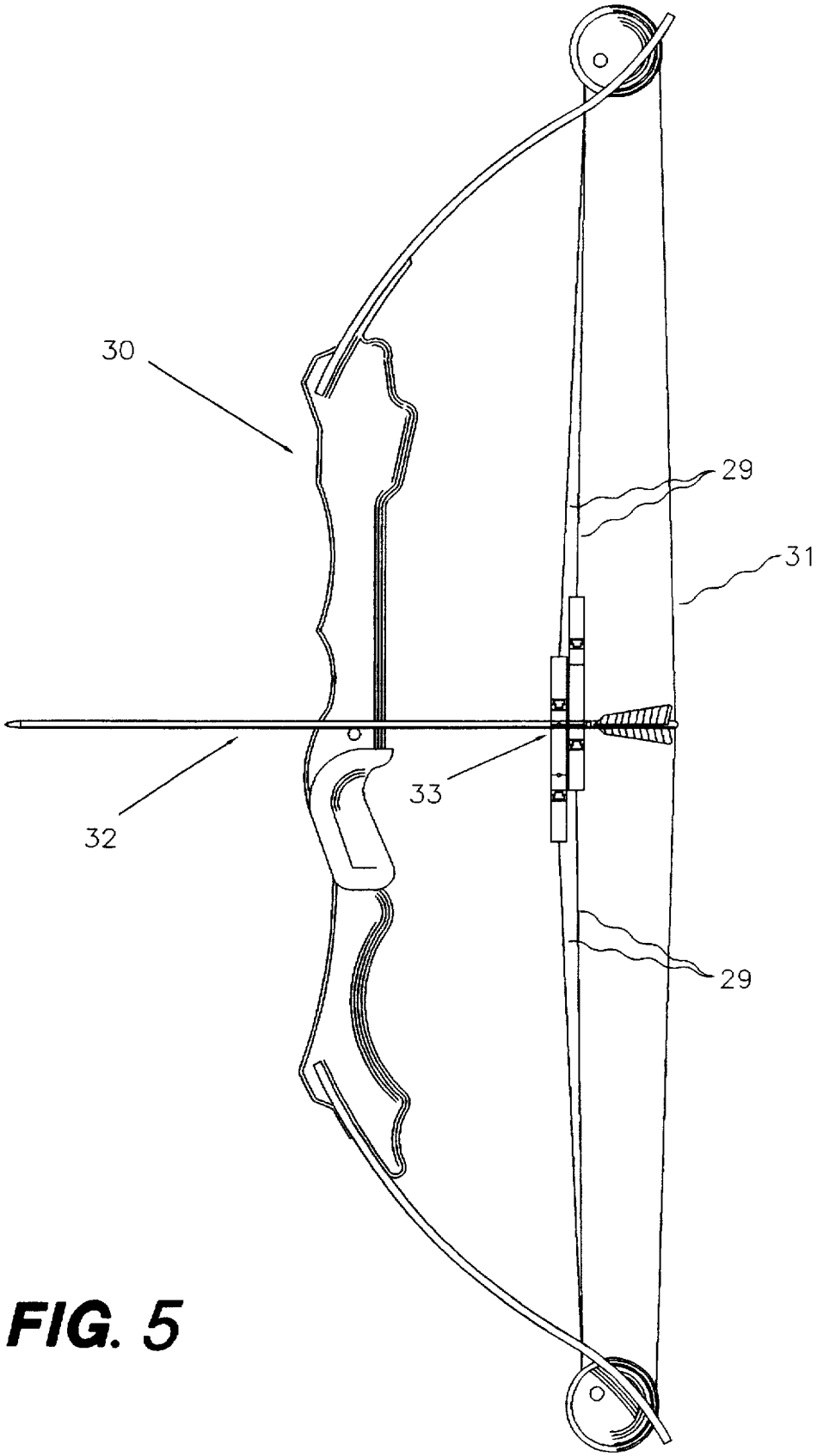
FIG. 5, shows a view of a compound bow and the Window Assembly for a Compound Bow attached.

Referring now to FIG. 5, shows a compound bow 30 in its entirety with the Window Assembly for a Compound Bow 33 in location on the cables 29. The arrow 32 is shown on the string 31 directly over the index line.

Referring back to FIG. 1, the cables 29 are attached to the Window Assembly for a Compound Bow 33 in the following sequence: the top head 8 of the front body 6 attaches to the cable 29 leading from the axle of the top limb. The bottom head 8 of the front body 6 receives the cable 29 from the bottom limb wheel. The bottom head 8 of the back body 7 receives the cable 29 from the axle of the bottom limb, the top head 8 of the back body 7 receives the cable 29 from the top limb wheel. Thus, the flow of motion is that the front body 6 moves in the direction of the bottom limb, and the back body 7 traverses towards the top limb when the bow is activated. During this transition, the window 33 is maintained thru-out. The above movements are related to a right hand bow.

Although this invention has been illustrated and described in connection with particular embodiments thereof, it will be apparent to those skilled in the art, that various changes and modifications may be made therein, without departing from the spirit of the invention or from the scope of the appended claims. Accordingly, the drawings and descriptions will be regarded as illustrative in nature and not as restrictive.

REFERENCE NUMBERS IN DRAWINGS

6. front body
7. back body
8. head
9. cap.
10. right hand index
11. front body channel
12. guide post
13. guide post bearing
14. cap lock bolt
15. threaded hole for anchor post
16. back body step
17. left hand index
18. receiving cap bolt
19. cap locking bolt hole
20. holes in the dividing slide bearing to receive bosses and guide post
21. threaded holes in boss to receive guiding post
22. cable anchor
23. cable channel in head
24. depression in head for anchor bolt and cable loop
25. dividing slide bearing
26. lock bolt for guide post
27. threaded hole for lock bolt for guide post
28. receiving slot for lock bolt
29. cables
30. bow
31. bowstring
32. arrow
33. window
34. back body channel

I claim:

1. For use with a compound bow which comprises a handle riser, upper and lower limbs, pulleys at the tips of the limbs, a bow string extending between the limb tips, and first and second power cables extending between the limb tips, in which the handle riser, upper and lower limbs, and bowstring define a bow plane in which an arrow is rocked and released, and in which the handle riser includes an arrow rest and the bowstring includes a hocking point which define a launch path for an arrow, and in which said power cables extend in said bow plane and cross said launch path, thus potentially interfering with the release of an arrow, a device for replacing the portion of said first and second power cables that would intersect said launch path, to create an unobstructed window to allow arrow release, said device comprising:

a front body comprising a front elongated member, a front upper head attached at an upper end of said front elongated member, a front lower head attached at a lower end of said front elongated member, said front upper and front lower heads being laterally offset from said front elongated member, said front upper head including means to attach to the portion of said first power cable which extends from said upper limb, said front lower head including means to attach to the portion of said first power cable which extends from said lower limb;

a back body comprising a back elongated member, a back upper head attached at an upper end of said back elongated member, a back lower head attached at a lower end of said back elongated member, said back upper and back lower heads being laterally offset from said back elongated member, said back upper head including means to attach to the portion of said second power cable which extends from said upper limb, said back lower head including means to attach to the portion of said second power cable which extends from said lower limb;

means to slidably attach said front and back bodies so that the heads lie in approximately the bow plane, but the elongated members are offset from the bow plane to create a window which allows unobstructed arrow release.

2. The device of claim 1, in which said front elongated member includes an elongated channel extending therethrough in a direction parallel to said bow plane when in use, said back elongated member includes at least one threaded hole alignable with said elongated channel, and said means to slidably attach said front and back bodies is a threaded guide post extending through said elongated channel and threaded into one said threaded hole.

3. The device of claim 2, further comprising a slot on said guide post engageable with a lock bolt, providing a lock to avoid rotation of said guide post.

4. The device of claim 2, in which said back elongated member includes a channel, and a dividing slide bearing received in said channel and positioned to abut said front elongated member.

5. The device of claim 2, in which said back body includes two said threaded holes engageable with said guide post, contributing to usage with left or right hand compound bows.

6. The device of claim 1, in which said means to attach the anchor cables to each head is an anchor post received in each head.

7. The device of claim 6, in which each head includes a depression means for receiving and securing each said anchor post.

8. The device of claim 7, further comprising a cap over each head to cover each anchor post.

9. The device of claim 8, further comprising a means for locking each said cap to a respective head.

10. The device of claim 1, further comprising an index line on said front and back bodies to assist in aligning the bodies to establish the maximum window size at any given draw length.

* * * * *